US005398707A

United States Patent [19]

Harris et al.

[11] Patent Number: 5,398,707

[45] Date of Patent: Mar. 21, 1995

[54] CLEANING APPARATUS FOR LOW DENSITY OBJECTS

[75] Inventors: Hank J. Harris, Lombard, Ill.; Phil D. Fitzgerald, Oklahoma City, Okla.

[73] Assignee: Brunswick Corporation, Lake Forest, Ill.

[21] Appl. No.: 185,684

[22] Filed: Jan. 24, 1994

[51] Int. Cl.[6] ..... B08B 3/02

[52] U.S. Cl. ..... 134/58 R; 134/95.2; 134/95.3; 134/99.2; 134/104.3; 134/113

[58] Field of Search ..... 134/58 R, 95.2, 95.3, 134/99.1, 99.2, 102.3, 104.3, 113

[56] References Cited

U.S. PATENT DOCUMENTS

| | | | |
|---|---|---|---|
| 4,456,022 | 6/1984 | Roberts | 134/99.1 |
| 4,782,843 | 11/1988 | Lapaglia | 134/104.3 |
| 4,934,392 | 6/1990 | Henfrey | 134/186 X |
| 5,139,577 | 8/1992 | Brock | 134/104.3 X |
| 5,180,437 | 1/1993 | Anderson et al. | 134/104.3 X |

FOREIGN PATENT DOCUMENTS

| | | | |
|---|---|---|---|
| 298332 | 3/1971 | U.S.S.R. | 134/102.3 |

*Primary Examiner*—Philip R. Coe

*Attorney, Agent, or Firm*—Wood, Phillips, VanSanten, Clark & Mortimer

[57] ABSTRACT

Toys in children's play lots such as low density balls may be readily cleaned in a cleaning apparatus including a cleaning compartment (10) having an access opening (16) through which toys to be cleaned may be introduced. The compartment (10) includes a pan-like wall (22) with a sloping surface and a port (24) is located in the wall (22) at substantially the lowest point thereof. A blower (40) provides a high volume stream of air that may be injected into the chamber (10) through the port (24) to entrain the objects to be cleaned in an air stream therein. A spray nozzle (34) is disposed within the compartment (10) and operative to spray washing and rinsing liquids on toys therein to be cleaned. After the toys are washed and rinsed, the blower (40) may be utilized to dry the toys.

15 Claims, 3 Drawing Sheets

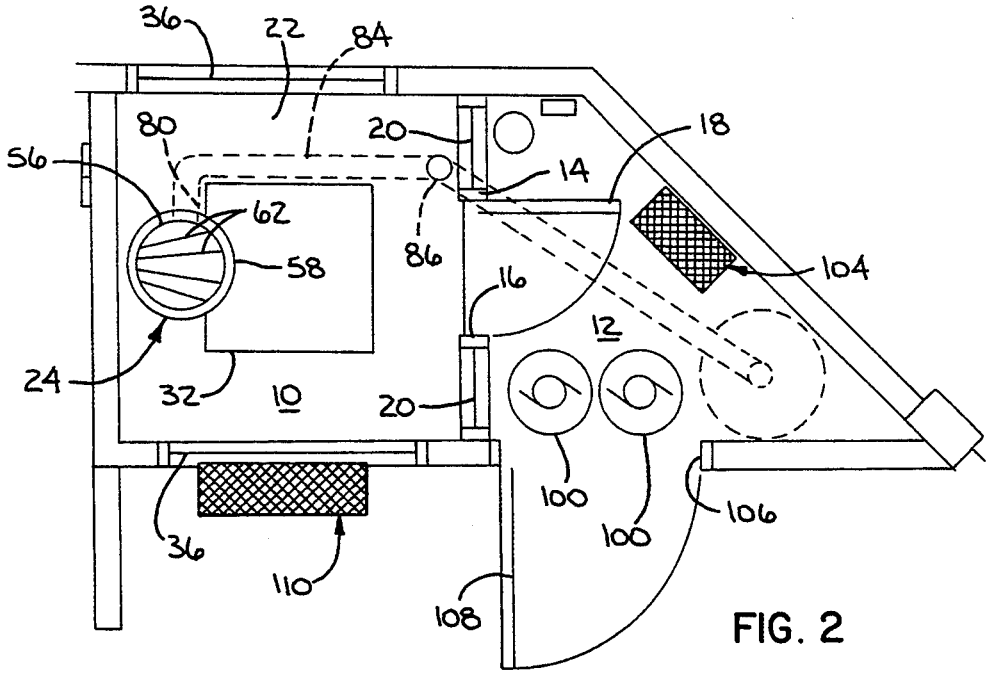
FIG. 2
FIG. 3
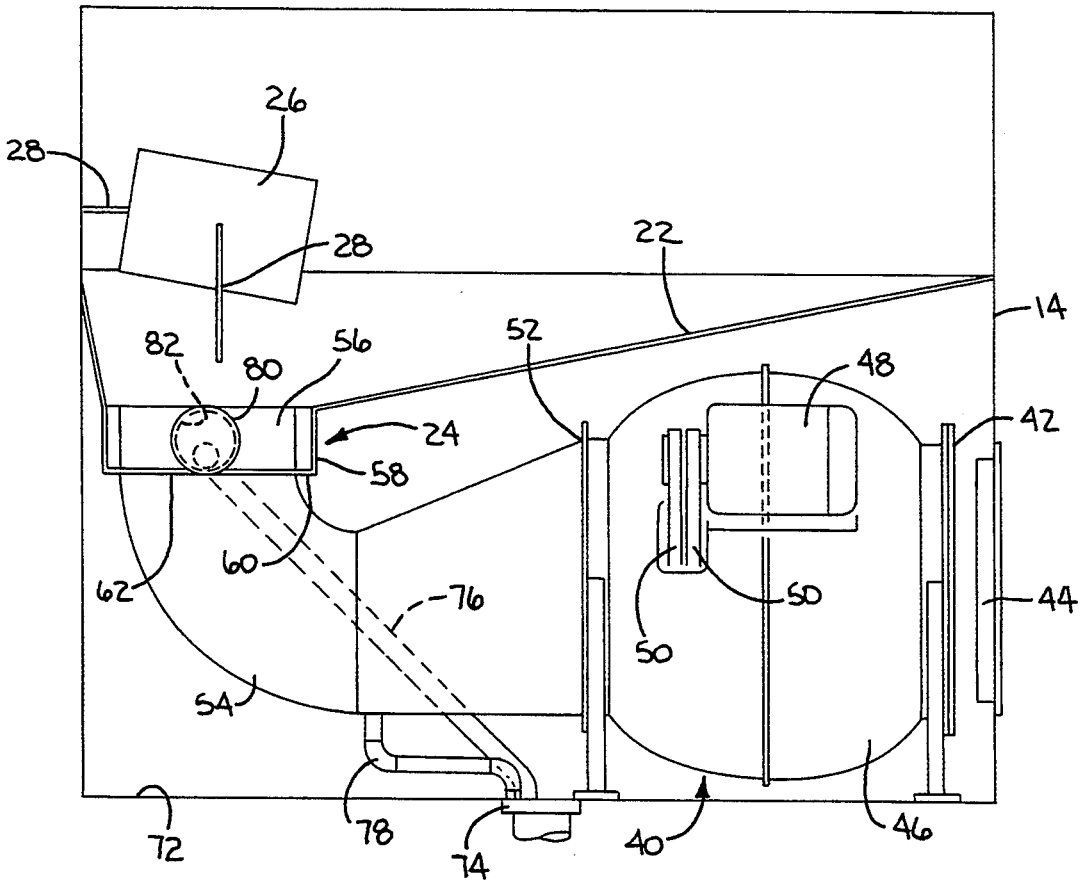

CLEANING APPARATUS FOR LOW DENSITY OBJECTS

FIELD OF THE INVENTION

This invention relates to a cleaning apparatus, and more specifically, to an apparatus for cleaning low density objects such as light weight plastic balls used at children's play lots.

BACKGROUND OF THE INVENTION

Play lots for children have long been part of the scene in park systems, educational systems, etc. Such lots conventionally sport a variety of apparatus and toys with which the children may play and otherwise amuse themselves. Generally, the more the children are amused or otherwise have their attention occupied by the apparatus or toys at a play lot, the less adult attention is required in supervising the children.

As a consequence, increasingly, business establishments that cater to adults of child bearing age are establishing their own play lots. Consequently, an adult with a young child may frequent the business and conduct business accordingly without interference by their child or children by leaving the child or children at a play lot established by the business. Increasingly, this has become popular in recreation centers as, for example, bowling houses and fast food emporiums. The children occupy themselves at the establishment play lot while their parents enjoy a line or lines or bowling or a meal.

One typical play lot feature that meets all of these criteria is a pit filled with low density, brightly colored, plastic balls. The balls typically may be formed or a material such as a low density polyethylene into hollow spheres of approximately 3" in diameter. Because of the particular material used, the balls are relatively soft so as to deflect when squeezed and yet restored to their original shape when pressure is released. Thus, the balls always look like they are in their original condition and not deformed. At the same time, they may be partially, temporarily, crushed through the weight of children playing in the pit and this feature avoids bruising children as might be the case if the objects were hard and unyielding. At the same time, the low mass of the balls means they are easily handled even by very young children and pose no danger when thrown. These attributes have resulted in toys of this type having great popularity.

One concern that parents of children have in connection with their children playing with toys or apparatus also used by other children is the spreading of diseases such as colds, flu, etc. This concern is not unique to any particular type of toy or apparatus, but is one that is fairly universal with parents of small children.

Occasionally, small children will try to place a toy or other object in their mouth and the low density balls mentioned previously are no exception. To avoid the possibility that such could result in contamination of the ball or balls of the toy, which in turn could be communicated to other children, it is necessary that the balls be periodically cleaned. The present invention is directed to providing an apparatus that may be readily used for cleaning low density objects such as the balls mentioned above.

SUMMARY OF THE INVENTION

It is the principal object of the invention to provide a new and improved cleaning apparatus for low density objects. More specifically, it is an object of the invention to provide such a cleaning apparatus that is easy to load and unload and which does a very effective job of cleaning the objects.

It is also an object of the invention to provide such a cleaning apparatus that, when in operation, provides an interesting display to captivate the attention of an observer of the cleaning process.

According to the invention, in one of its embodiments, there is provided a cleaning apparatus that includes a cleaning compartment with an access opening to the compartment through which objects to be cleaned maybe introduced into the compartment for cleaning therein.

A sloping surface is located within the compartment below the access opening and a port is provided in the sloping surface at substantially the lowest point thereof. A blower is provided for generating a high volume stream of air and introducing the same into the compartment so as to entrain objects therein. A drain for the compartment is connected to the port and a spray nozzle is located within the compartment. Means are also provided for supplying a cleaning liquid to the nozzle. Means are provided for supplying a rinsing liquid to the spray nozzle. Means are provided for sequentially operating the cleaning liquid supplying means and the rinsing liquid supplying means while operating the blower to first clean objects in the compartment and then rinse the objects and for thereafter continuing operation of the blower to dry objects in the compartment. A collection hopper is also provided in another compartment for collecting the objects after they have been cleaned, rinsed and dried.

In a preferred embodiment of the invention, the collection hopper is connected to the port.

In one embodiment of the invention, the port is defined by generally concentric sleeves and the blower is connected to the innermost sleeve and a compartment drain is connected to the outer most sleeve. In the one embodiment of the invention, the means for supplying a cleaning liquid and the means for supplying a rinsing liquid comprise a conduit extending to the spray nozzle and adapted to be connected to a pressurized water source. A valve is located in the conduit and a reservoir adapted to contain a soap is provided. A pump is connected to the conduit downstream of the valve and upstream of the spray nozzle, as well as to the reservoir. The pump is for pumping soap into the conduit. A timer is provided for first opening the valve and operating the pump to provide a wash cycle and thereafter, opening the valve while terminating operation of the pump to provide a rinse cycle.

In another aspect, the invention includes a cleaning apparatus for low density objects which has a cleaning compartment with an access opening as mentioned previously. A drain is connected to the cleaning compartment and a spray nozzle is located within the compartment for spraying washing and rinsing liquids on objects within the compartment. Means are provided for drying objects within the compartment. A collection hopper is disposed exteriorally of the compartment and has a lower discharge opening. An upper entrance to the collection hopper is provided and an exit opening in the compartment is sized to allow objects to be cleaned to egress the compartment. A conveying tube extends from the hopper entrance to the exit opening and means are provided for selectively creating a pressure differential between the compartment and the hopper so that objects in the compartment, after being washed, rinsed, and dried therein, may move into the exit opening to be conveyed through the tube to the hopper to be collected therein.

The invention contemplates that in a preferred embodiment, the lower discharge opening of the hopper is provided with a selectively operable valve for selectively opening or closing the lower discharge opening.

In a preferred embodiment, the pressure differential creating means comprises a fan.

In a highly preferred embodiment, the compartment includes a lower, sloping surface and the exit opening is at the lowermost point on the sloping surface.

The invention also contemplates a provision of means for agitating objects within the compartment. In a highly preferred embodiment, the agitating means comprising a blower for introducing a high volume stream of air into the compartment.

In still another aspect of the invention, the same includes a cleaning compartment with an access opening to the compartment through which objects to be cleaned may be introduced into the compartment for cleaning therein. A pan-like wall is provided for the compartment and below the access opening. The pan-like wall has a sloping surface facing the compartment. A port is located in the pan-like wall at substantially at the lowest point thereof and a blower is provided for generating a high volume stream of air. Means are provided to connect the blower to the port so the high volume stream may be introduced into the compartment through the port. An air nozzle is located within the compartment in alignment with the port and elevated above the pan-like wall so that objects to be cleaned may move into the port by passing below the air nozzle. The air nozzle directs the high volume stream and objects entrained therein generally upwardly within the compartment. A compartment drain is also connected to the port and a spray nozzle is disposed within the compartment at an elevated location therein and well above the air nozzle. Means are provided for supplying a cleaning liquid to the spray nozzle as are means for supplying a rinsing liquid to the spray nozzle. Means are provided for sequentially operating the cleaning liquid supplying means and the rinsing liquid supplying means while operating the blower to first clean objects in the compartment and then rinse the objects, and for thereafter, continuing operation of the blower to dry objects in the compartment. A collection hopper is located exteriorally of the compartment and has a lower discharge opening with means for selectively opening and closing the discharge opening to selectively allow objects collected in the hopper to be discharged therefrom. An upper entrance is provided to the collection hopper and an exit opening is located in the a side of the port and sized to allow the objects to be cleaned to egress the compartment. A conveying tube extends from the hopper entrance to the exit opening in the port and means are provided for selectively creating a low pressure within the hopper so that objects in the compartment, after being washed, rinsed and dried therein, may be drawn into the exit opening to be conveyed through the tube to the hopper to be collected therein.

In a preferred aspect of the invention, a second compartment is provided to house the hopper and has a common wall with the cleaning compartment. The access opening comprises a door in the common wall and a wall of the cleaning compartment other than the common wall is transparent.

Preferably, the air nozzle and the port are displaced from the center of the pan-like surface toward one side thereof to cause the objects being cleaned to travel in a generally loop-like path.

A preferred embodiment of the invention includes a first indicator lamp for illumination during operation of the cleaning liquid supplying means, a second indicator lamp for illumination during operation of the rinsing liquid supplying means, and a third indicator lamp for illumination when the blower is operating to dry objects in the compartment.

In a preferred embodiment, the means for selectively opening or closing the discharge opening of the hopper comprises a slide valve.

Other objects and advantages will become apparent from the following specification taken in connection with the accompanying drawing.

DESCRIPTION OF THE DRAWINGS

FIG. 2 is a horizontal section taken approximately along the line 2—2 in FIG. 1;

FIG. 3 is an enlarged elevational view of a lower part of the cleaning apparatus;

DESCRIPTION OF THE PREFERRED EMBODIMENT

Figure 1:
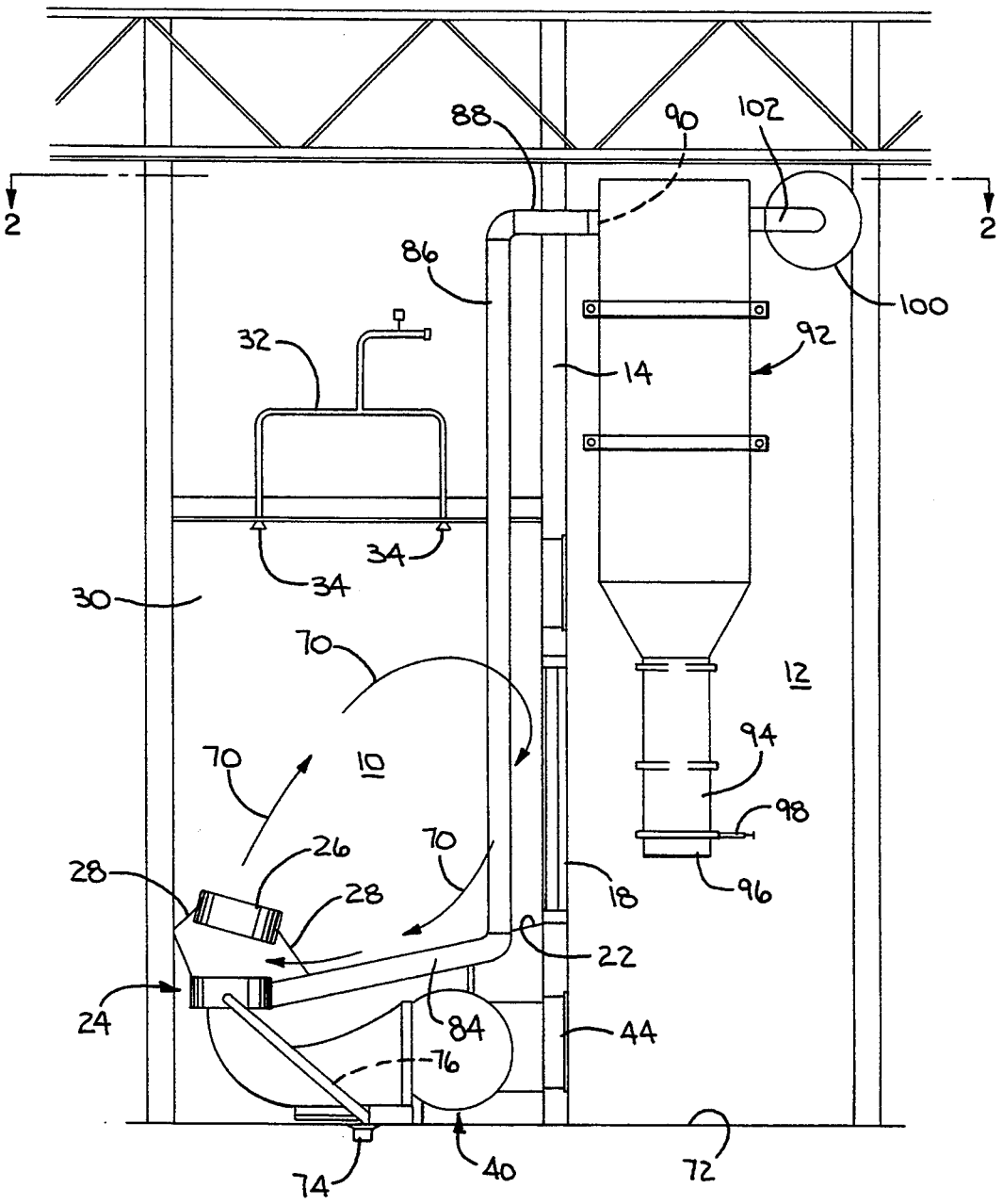
FIG. 1 is a vertical section of a cleaning apparatus made according to the invention.

An exemplary embodiment of a cleaning apparatus made according to the invention is illustrated in the drawings and with reference to FIGS. 1 and 2 is seen to include a cleaning compartment generally designated 10, and an adjacent collecting or storage compartment 12. The compartments 10 and 12 share a common wall 14. The wall 14 includes an access opening 16 which may be opened or closed by a door 18.

If desired, the wall 14 may include one or more window panels 20.

Near its lower end, the cleaning compartment 10 includes a pan-like wall 22. The pan-like wall 22 may be formed of, for example, stainless steel sheet so as to define an upper, sloping surface facing the cleaning compartment 10. At its lowermost point, the pan-like wall 22 includes a port, generally designated 24. As seen in FIG. 1, an air nozzle 26 defined by a sleeve mounted by stand-offs 28 above the pan-like surface 22 is provided. The air nozzle 26 is aligned with the port 24 and sufficiently elevated above the same so that objects to be cleaned as, for example, the aforementioned 3" hollow, plastic, light weight balls, can pass under its lower edge to the port 24 as will be seen.

The walls defining the compartment 10 may be provided with ceramic tiles 30 to make the compartment 10 waterproof. Near its upper end, a rectangular spray manifold 32 is provided. The manifold 32 includes a number of spray nozzles 34 that are directed downwardly within the compartment 10 and, as will be seen, serve to discharge both cleaning liquid and rinsing liquid.

As seen in FIG. 2, if desired, additional ones of the walls making up the compartment 10 may be provided with windows 36. The purpose of the windows 20 and 36 is to allow the people in the vicinity of the cleaning apparatus to view its operation, and specifically, the cleaning, rinsing and drying action on the low density objects placed in the cleaning chamber 10.

Turning to FIGS. 1 and 3, a means for agitating the objects to be cleaned within the cleaning chamber 10 is provided. Specifically, a blower, generally designated 40, includes an inlet end 42 adjacent a damper 44 located in the common wall 14. The blower 10 is located below the pan-like wall 22 and includes a blower housing 46 mounting an electric motor 48 connected by means of belts 50 to an internal impeller (not shown). The impeller drives a high volume of air to the blower outlet 52. Ducting 54 connects the outlet 52 of the blower 40 to the port 24.

More particularly, the port 24 is made up of two concentric sleeves, including an inner sleeve 56 and an outer sleeve 58. The outer sleeve 58 is joined to the pan-like surface 22 at its upper end and, at its lower end, by a web 60 to the lower end of the radially inner sleeve 56. As can be readily appreciated, liquid draining down the pan-like surface 22 because of the slope thereof will enter the port 24 to be received in the annulus defined by the sleeves 56 and 58.

Grate bars 62 extend across the radially inner sleeve 56 at the bottom edge thereof. The spacing of the grate bars 62 is such that objects to be cleaned within the compartment 10 cannot pass between adjacent grate bars 62.

The ducting 54 is coupled to the radially inner sleeve 56, and thus, the high volume stream of air from the blower 40 will be directed upwardly into the compartment 10 via the radially inner sleeve 56. In addition, the air nozzle 26, being aligned with the port 24, will receive the discharge from the blower 40. Preferably, the nozzle 26 is canted somewhat as shown in both FIGS. 1 and 3, particularly where, as in the exemplary embodiment, the port 24 is displaced to one side of the center of the pan-like surface 22.

Low density objects to be cleaned roll or slide down the pan-like surface 22 to enter the radially inner sleeve 56. The air stream emanating from the blower 40 entrains those objects because of their low density and blows them upwardly through the air nozzle 26. The canted angle of the air blower 26 results in the objects being thrown upwardly and across the compartment 10. As the air stream dissipates, its ability to continue to entrain the objects dissipates and gravity eventually causes the same to drop and return to the pan-like surface 22. A closed loop like path shown by arrows 70 in FIG. 1 results. Needless to say, where the objects are colored balls such as used in a toy as mentioned previously, the continual lifting and falling of the colored balls during operation of the blower is a spectacular and captivating sight which may be readily viewed through the windows 20 or 36.

Typically, the apparatus will be installed in a building having a floor 72. The floor 72 includes a drain 74 connected by any suitable means to a sewer system (not shown).

A first drain 76 extends from the annulus between the sleeves 56 and 58 to the drain 74. Thus, liquid entering the annulus after running down the sloped surface of the pan-like wall 22, is directed to the floor drain 74.

It is also possible, because of the moving air stream within the compartment 10 during operating of the apparatus, that liquid droplets may enter the sleeve 56 and from there pass into the ducting 54. As a result, a drain line 78 extends from a low point in the ducting 54 to the drain 74 provide a means of draining the ducting 54 as well.

In the usual case, the objects to be cleaned, rinsed and dried are introduced into the compartment 10 through the door 18. The invention contemplates a means for collecting the objects after they have been cleaned, rinsed and dried. In particular, a tube 80 sized to be sufficiently large as to allow the objects to be cleaned, rinsed and dried to travel therethrough extends through the outer sleeve 56 to an exit opening 82 in the radially inner sleeve 56. Consequently, objects travelling down the sloping surface of the pan-like wall 22 will enter the radially inner sleeve 56 and, if the blower 40 is not active, reside there, resting on the grate bar 62 in adjacency to the exit opening 82.

As seen in FIGS. 1 and 2, the tube 80 is connected to a conveying conduit 84 which extends generally under the pan-like wall 22 to a point near one edge thereof to emerge there through into a vertically extending conveyor conduit 86.

At the top of the compartment, the conveyor tube includes a horizontal run 88 which passes through the common wall 14 into the compartment 12. The same extends through an entrance opening 90 in the upper end of a funnel like collection hopper, generally designated 92. The hopper 92 has a lower end formed as a reduced diameter spout 94 terminating in a discharge opening 96. Adjacent the discharge opening 96, the spout 94 includes a conventional slide valve 98 which may be opened to allow objects within the hopper 92 to pass out of the same, or which may be closed to retain the objects therein.

The tubes 80, 84, 86, 88 act as a pneumatic conveying system for conveying the objects from the compartment 10 to the hopper 92. To operate the pneumatic system, a pair of exhaust fans 100 are connected to the hopper 92 near its upper end via a conduit 102. Desirably, the fans 100 are coupled in series to the hopper 92.

As seen in FIG. 2, a control panel, shown somewhat schematically at 104 may be located in the compartment 12. In addition, the compartment 12 may have an access opening 106 that is closable by a door 108.

If desired, a wash indicator panel, shown somewhat schematically at 110, can be provided on the exterior of one of the walls of the compartment 10, preferably above one of the windows 36.

Figure 4:
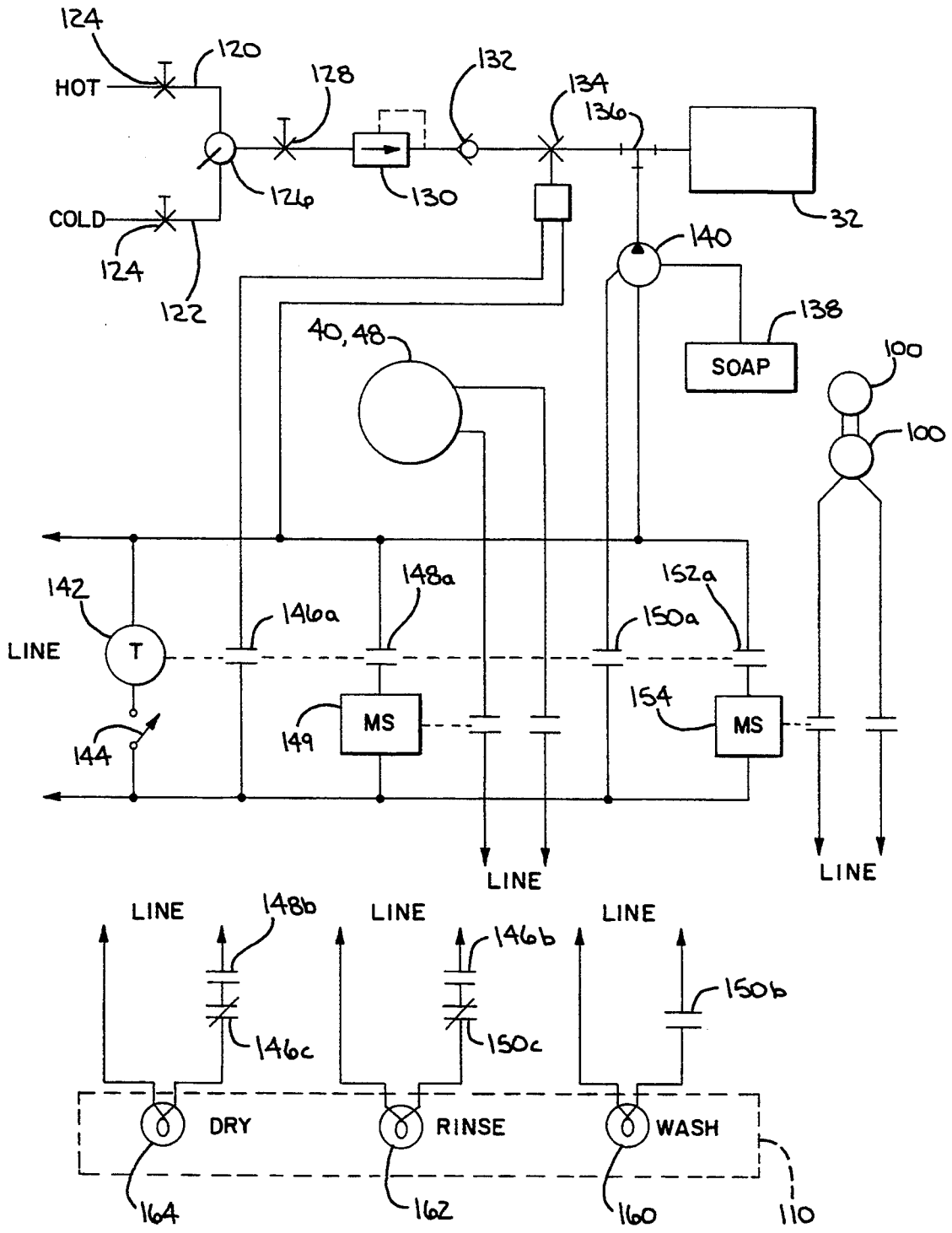
FIG. 4 is a schematic of a control system for the cleaning apparatus.

FIG. 4 illustrates a combined plumbing and electrical schematic for the apparatus. Conduits 120 and 122 may be connected through respective shut-off valves 124 to sources of hot and cold water under pressure. The conduits 122 are connected to a mixing valve 126 which proportions the flow of hot and cold water to provide water of a desired temperature. The output of the mixing valve 126 is run via a valve 128 through a pressure reducing valve 130 of conventional construction. From the pressure reducing valve 130, flow is through a back flow preventer, shown schematically as a check 132, and then to a solenoid operated valve 134. From the valve 134, the liquid may pass to a tee 136 and then to the manifold 32.

The system includes a soap reservoir 138. A soap pump 140 is interposed between the reservoir 138 and the tee 136. The pump 140 is electrically operated and when energized, will pump soap from the reservoir 138 to the tee 136 where it may mix with water (assuming the various valves are open) to be ejected as a soap or cleaning solution from the manifold 32 and the spray nozzles 34 associated therewith.

Electrically, the apparatus includes a timer 142 which can be connected across the line via a manually operated off/on switch 144. The timer 142 is operable to open or close various contacts in a conventional fashion. For example, a set of normally opened contacts 146*a* may be closed by the timer 142 to energize the solenoid valve 134 to open the same, thereby allowing the flow of water to the spray manifold 32.

A second set of normally opened contacts 148*a* are in series with a conventional motor starter 149. The motor starter 149 operates conventionally to close contacts to connect the blower motor 48 to the line to energize the same.

A third set of normally open contacts 150*a* are operable to energize the soap pump 140 while a fourth set of normally opened contacts 152*a* are in series across the line with another conventional motor starter 154 which is operable to connect the two fans 100 to line for the purpose of conveying the objects to be cleaned from the cleaning compartment 10 to the storage hopper 92.

The timer 142 and appurtenances are conventional. They are set-up so that initially, the contacts 146*a*, the contacts 148*a*, and the contacts 150*a* are all closed for a five minute period. This will result in the opening of the solenoid valve 134 and the flow of liquid to the spray manifold to be sprayed within the compartment 10, the operation of the blower 40 to blow a high volume stream of air into the compartment 10, and the operation of the soap pump 140 to pump soap into the liquid stream that is ultimately discharged from the spray nozzles 34. As a consequence, low density objects to be cleaned will be agitated and moving in the path shown schematically at 70 in FIG. 1 below the spray nozzles 34 to be thoroughly covered and cleaned with a soap solution.

After five minutes, the timer allows the contacts 150*a* to revert to their normally opened condition while maintaining the contacts 146*a* and 148*a* closed. As a consequence, the flow of soap will halt, but water flow and air flow will continue. Thus, the objects will continue to be agitated within the compartment 10 while being bathed in a water spray from the spray nozzles 34. This condition is also maintained for five minutes to provide a complete rinse of the objects.

Following the rinse cycle, the contacts 146*a* revert to their normally opened position while the contacts 148*a* remain closed. As a consequence, only the blower 40 will be operating, continuing to move the objects to be cleaned in the path 70 (FIG. 1) with the result that the same will be dried. Again, depending upon humidity conditions in a particular location, a five minute drying cycle will be sufficient.

Following the drying cycle, the timer 142 will cause the contacts 148*a* to open which in turn will cause the motor starter 149 to de-energize the blower 40. At this time, the contacts 152*a* may be closed causing the motor starter 154 to energize the fans 100. Because the blower 40 is no longer operating, the objects will settle to the bottom of the compartment 10 and because of the slope of the pan-like surface 22, descend to the port 24. The operation of the fans 100 will create a low pressure area within the hopper 92 and as a consequence, the objects will be drawn into the exit opening 82 (FIG. 3) in the compartment 10 and travel to the hopper 92 to be collected therein.

To liven up the display for the casual observer, it may be desirable that the panel 110 include lights to indicate the sequence of the system as it progresses through a wash, rinse and dry cycle. To this end, the panel 110 may include a wash indicating lamp 160, a rinse indicating lamp 162 and a dry indicating lamp 164.

Normally opened contacts 150*b* ganged with the contacts 150*a* to be operated by the timer 142 are placed in series across the line with the wash lamp 160. As a consequence, the wash lamp will be illuminated whenever soap pump 140 is energized which, of course, is coincident with the occurrence of a washing cycle.

The rinse lamp 162 is connected across the line through the serial combination of normally opened contacts 146*b* ganged with the contacts 146*a* and normally closed contacts 150*c* ganged with the contacts 150*a*. As a consequence, the rinse lamp 162 will be illuminated when the contacts 150*c* are closed which is indicative of the fact that the soap pump 140 is turned off, and when the contacts 146*b* are closed which is indicative of the solenoid valve 134 being opened. In other words, the rinse lamp 162 will illuminate whatever water is flowing to the manifold 32, but soap is not. This, of course, corresponds to a rinse cycle.

The dry lamp 164 is connected to line across the serial combination of normally closed contacts 146*c* and normally opened contacts 148*b*, ganged with the contacts 146*a* and 148*a* respectively. The contacts 146*c* will be closed only when the solenoid valve 134 is not energized, i.e., when water is not being fed to the manifold 32. Thus, the contacts 146*c* will be closed so long as neither a wash nor a rinse cycle is occurring.

The contacts 148*b* will be closed whenever the contacts 148*a* close, which means that the contacts 148*b* will close when the blower 40 is energized. Consequently, the dry lamp 164 will illuminate only when the blower 40 is operating but no water is flowing through the manifold 32. This, of course, corresponds to a drying cycle.

From the foregoing, it will be appreciated that a cleaning apparatus according to the invention is relatively simple in construction in terms of not requiring complex machinery, mechanisms or the like. As a consequence, it may be made extremely reliably. At the same time, the same provides for a thorough cleaning of low density objects and in a way such that the process may be observed by persons in the area. Loading of the objects to be cleaned into the cleaning chamber 10 is readily accomplished through the door 18 which may be as simple as a conventional shower door while retrieval of cleaned objects may be easily accomplished simply by securing, for example, a mesh sack to the lower end of the discharge spout about the discharge opening 96 and then opening the slide valve 98 to release the objects from the hopper 92.

By providing the indications of the stages in the total cleaning cycle through which the apparatus is progressing along with a view of the operation as it is performed, those persons most interested in ensuring a clean play environment for their children may readily view operation of the machine and be assured thereby that their child will, in fact, be playing in a clean environment.

We claim:

1. Cleaning apparatus for low density objects comprising:

a cleaning compartment;

an access opening to said compartment through which objects to be cleaned may be introduced into said compartment for cleaning therein;

a pan-like wall for said compartment and below said access opening, said pan-like wall having a sloping surface facing said compartment;

a port in said pan-like wall at substantially the lowest point thereof;

a blower for generating a high volume stream of air;

means connecting said blower to said port so that said high volume stream may be introduced into said compartment through said port;

an air nozzle within said compartment aligned with said port and elevated above said pan-like wall so that objects to be cleaned may move into said port by passing below said air nozzle;

said air nozzle directing said high volume stream and objects entrained therein generally upwardly within said compartment;

a compartment drain connected to said port;

a spray nozzle within said compartment at an elevated location therein and well above said air nozzle;

means for supplying a cleaning liquid to said spray nozzle;

means for supplying a rinsing liquid to said spray nozzle;

means for sequentially operating said cleaning liquid supplying means and said rinsing liquid supplying means while operating said blower to first clean objects in said compartment and then rinse the objects, and for thereafter continuing operation of said blower to dry objects in said compartment;

a collection hopper exteriorly of said compartment; said hopper having a lower discharge opening with means for selectively opening or closing said discharge opening to selectively allow objects collected in said hopper to be discharged therefrom;

an upper entrance to said collection hopper;

an exit opening in a side of said port and sized to allow the objects to egress said compartment;

a conveying tube extending from said entrance to said exit opening in said port; and means for selectively creating a low pressure within said hopper so that objects in said compartment, after being washed, rinsed and dried therein, may be drawn into said exit opening to be conveyed through said tube to said hopper to be collected therein.

2. The cleaning apparatus of claim 1 including a second compartment housing said hopper and having a common wall with said cleaning compartment; said access opening comprising a door in said common wall; and a wall of said cleaning compartment other than said common wall being transparent.

3. The cleaning apparatus of claim 1 wherein said air nozzle and said port are displaced from the center of said pan-like surface toward one side thereof to cause the objects being cleaned to travel in a generally loop-like path.

4. The cleaning apparatus of claim 1 further including a first indicator lamp for illumination during operation of said cleaning liquid supplying means; a second indicator lamp for illumination during operation of said rinsing liquid supplying means; and a third indicator lamp for illumination when said blower is operating to dry objects in said compartment.

5. The cleaning apparatus of claim 1 wherein said means for selectively opening or closing said discharge opening comprise a slide valve.

6. Cleaning apparatus for low density objects comprising:

a cleaning compartment;

an access opening to said compartment through which objects to be cleaned may be introduced into said compartment for cleaning therein;

a sloping surface within said compartment below said access opening;

a port in said sloping surface at substantially the lowest point thereof;

a blower for generating a high volume stream of air and introducing the same into said compartment so as to entrain objects therein;

a compartment drain connected to said port;

a spray nozzle within said compartment;

means for supplying a cleaning liquid to said spray nozzle;

means for supplying a rinsing liquid to said spray nozzle;

means for sequentially operating said cleaning liquid supplying means and said rinsing liquid supplying means while operating said blower to first clean objects in said compartment and then rinse the objects, and for thereafter continuing operating of said blower to dry objects in said compartment; and a collection hopper exteriorly of said compartment for collecting objects after they have been cleaned, rinsed and dried.

7. The cleaning apparatus of claim 6 wherein said collection hopper is connected to said port.

8. The cleaning apparatus of claim 6 wherein said port is defined by generally concentric sleeves and said blower is connected to the innermost sleeve and said compartment drain is connected to the outermost sleeve.

9. The cleaning apparatus of claim 6 wherein said means for supplying a cleaning liquid and said means for supplying a rinsing liquid comprise a conduit extending to said spray nozzle and adapted to be connected to a pressurized water source, a valve in said conduit, a reservoir adapted to contain soap, a pump connected to said conduit downstream of said valve and upstream of said spray nozzle, and to said reservoir, for pumping soap into said conduit, and a timer for first opening said valve and operating said pump to provide a wash cycle, and thereafter, opening said valve while terminating operation of said pump to provide a rinse cycle.

10. Cleaning apparatus for low density objects comprising:

a cleaning compartment;

an access opening to said compartment through which objects to be cleaned may be introduced into said compartment for cleaning therein;

a drain connected to said compartment;

a spray nozzle within said compartment for spraying, washing and rinsing liquids on objects within said compartment;

means for drying objects within said compartment;

a collection hopper exteriorly of said compartment; said hopper having a lower discharge opening;

an upper entrance to said collection hopper;

an exit opening in said compartment and sized to allow the objects to egress said compartment;

a conveying tube extending from said entrance to said exit opening; and means for selectively creating a pressure differential between said compartment and said hopper so that objects in said compartment, after being washed, rinsed and dried therein, may move into said exit opening to be conveyed through said tube to said hopper to be collected therein.

11. The cleaning apparatus of claim 10 wherein said lower discharge opening is provided with a selectively operable valve for selectively opening or closing said lower discharge opening.

12. The cleaning apparatus of claim 10 wherein said pressure differential creating means comprises a fan.

13. The cleaning apparatus of claim 10 wherein said compartment includes a lower, sloping surface, and said exit opening is at the lowermost point on said sloping surface.

14. The cleaning apparatus of claim 13 further including means for agitating objects within said compartment.

15. The cleaning apparatus of claim 14 wherein said agitating means comprises a blower for introducing a high volume stream of air into said compartment.

* * * * *